US009016346B2

(12) United States Patent
Cha

(10) Patent No.: US 9,016,346 B2
(45) Date of Patent: Apr. 28, 2015

(54) DOUBLE ROMAN SHADE CURTAIN AND DOUBLE ROMAN SHADE USING THE SAME

(71) Applicant: Daekyeong Triple Co., Ltd., Daegu (KR)

(72) Inventor: Sang-Gun Cha, Daegu (KR)

(73) Assignee: Daekyeong Triple Co., Ltd., Daegu (KR)

( * ) Notice: Subject to any disclaimer, the term of this patent is extended or adjusted under 35 U.S.C. 154(b) by 57 days.

(21) Appl. No.: 13/945,303

(22) Filed: Jul. 18, 2013

(65) Prior Publication Data

US 2014/0367053 A1 Dec. 18, 2014

(30) Foreign Application Priority Data

Jun. 17, 2013 (KR) ..... 10-2013-0069133

(51) Int. Cl.
*E06B 9/262* (2006.01)
*A47H 5/032* (2006.01)

(52) U.S. Cl.
CPC ..... *A47H 5/032* (2013.01); *E06B 9/262* (2013.01); *E06B 2009/2627* (2013.01)

(58) Field of Classification Search
USPC ..... 160/84.01, 84.04, 84.05, 84.06, 84.03, 160/178.3, 121.1, DIG. 7; 139/384 A, 384 R
IPC ..... E06B 2009/2627
See application file for complete search history.

(56) References Cited

U.S. PATENT DOCUMENTS

| | | | | | |
|---|---|---|---|---|---|
| 2,141,038 | A * | 12/1938 | French | 139/384 A |
| 2,142,900 | A * | 1/1939 | Hinlein et al. | 66/170 |
| 2,275,273 | A * | 3/1942 | Taylor | 66/170 |
| 3,256,928 | A * | 6/1966 | Hensel | 160/178.3 |
| 4,880,044 | A * | 11/1989 | Judkins | 160/84.04 |
| 4,921,032 | A * | 5/1990 | May | 160/84.01 |
| 5,188,160 | A * | 2/1993 | Jelic | 160/84.02 |
| 5,753,338 | A * | 5/1998 | Jelic et al. | 428/116 |
| 5,785,094 | A * | 7/1998 | Yoshida | 139/384 R |
| 6,378,567 | B1 * | 4/2002 | Chen | 139/383 R |
| 6,672,361 | B2 * | 1/2004 | Fransen | 160/85 |
| 6,834,701 | B2 * | 12/2004 | Colson et al. | 160/121.1 |
| 7,694,696 | B2 * | 4/2010 | Chang et al. | 139/423 |
| 8,496,041 | B2 * | 7/2013 | Li | 160/178.3 |
| 2009/0139665 | A1 * | 6/2009 | Cha | 160/87 |
| 2011/0120661 | A1 * | 5/2011 | Kim | 160/89 |

FOREIGN PATENT DOCUMENTS

KR 10-1153854 B1 6/2012

* cited by examiner

*Primary Examiner* — David Purol

(57) ABSTRACT

Disclosed herein is a double roman shade curtain which is configured to include a first curtain 10, a second curtain 20, a connection belt 30, and a cord 40. Further, the present invention relates to a double roman shade curtain which is configured to include a first curtain 10, a second curtain 20, a connection belt 30, a cord 40, a rotating bar 50, a frame 60, and a tow rope 70. Therefore, the double roman shade curtain and the double roman shade using the same can be integrally woven without separately forming the ring and prevent accidents that children are wound with the cord and can be formed in both surfaces to have a beautiful appearance, be installed without dividing front and back faces, and have excellent durability.

13 Claims, 10 Drawing Sheets

DOUBLE ROMAN SHADE CURTAIN AND DOUBLE ROMAN SHADE USING THE SAME

CROSS REFERENCE TO RELATED APPLICATION

This application claims the benefit of Korean Patent Application No. 10-2013-0069133, filed on Jun. 17, 2013, entitled "DOUBLE ROMAN SHADE CURTAIN AND DOUBLE ROMAN SHADE USING THE SAME", which is hereby incorporated by reference in its entirety into this application.

BACKGROUND OF THE INVENTION

1. Technical Field

The present invention relates to a double roman shade curtain and a double roman shade using the same, and more particularly, to a double roman shade curtain in which curtains are provided double and connected to each other by a connection belt and a cord is provided therebetween, and a double roman shade using the same.

2. Description of the Related Art

A curtain has generally been used to block light or objects in daily life, such as blocking sunlight, covering the stage, or the like. Various kinds of curtains have been used in daily life. For example, there are a general curtain unfolded and folded left and right, a vertical blind consisting of a plurality of pieces of which the tilt angle may be adjustable, a roll screen curtain wound and unwound around a rotating roll, a roman shade folded by a winding operation of a length adjustable string, and the like.

In recent, as people consider functions and esthetic elements of a curtain important, a roman shade with a beautifully folded shape has become popular. the roman shade basically forms a plurality of layers as a curtain portion ascends while being folded, the roman shade fundamentally has a beautiful appearance when it completely ascends.

The roman shade type blind according to the related art is disclosed in Patent Document 1. FIG. 1 is a front view illustrating a roman shade type blind according to the related art, FIG. 2 is a partial side cross-sectional view illustrating the roman shade type blind according to the related art, in which the roman shade type blind according to the related art is configured of a fabric 3, a ring 4, and a cord 5. As illustrated in FIG. 1, the fabric 3 is woven by intersecting warps 1 with wefts 2. Among them, some of the wefts 2 do not intersect the warps 1, and thus the ring 4 is formed. Referring to FIG. 2, the warps 1 do not intersect some of the wefts 2 while the warps 1 intersect the wefts 2 by passing through between the wefts 2, such that the wefts 2 of a portion through which the warps 1 do not pass are collected to form the rings 4. Therefore, the so formed ring 4 passes through the cord 5, such that the roman shade type blind according to the related art is completed.

However, since the roman shade type blind according to the related art separately forms the ring 4 so as to connect the cord 5 to the fabric 3, some of the wefts 2 need not to intersect the warps 1, which leads to a complicated weaving process.

Further, since some of the wefts 2 do not intersect the warps 1 in order to form the ring 4, durability of the corresponding portion may be weakened.

Further, the cord 5 is generally made of a transparent, thin, and hard material so as not to be seen well in the appearance even though the cord 5 is exposed to the outside. In this case, owing to the structure in which the cord 5 is exposed to the outside, the accidents that the cord 5 is wound around a child's hand or neck during playing may occur.

RELATED ART DOCUMENT

Patent Document (Patent Document 1) KR 10-1153854 B1 (Jun. 18, 2012)

SUMMARY OF THE INVENTION

An object of the present invention is to provide a double roman shade curtain capable of being integrally woven by including a connection belt while preventing a cord from being exposed to the outside and having a curtain formed double, and a double roman shade using the same.

According to an exemplary embodiment of the present invention, there is provided a double roman shade curtain, including: a first curtain including a first weft and a first warp intersecting the first weft; a second curtain including a second weft and a second warp intersecting the second weft and disposed to face the first curtain; a connection belt formed between the first curtain and the second curtain along a horizontal direction and connecting the first curtain to the second curtain; and a cord penetrating through the connection belt to be fixed to lower portions of the first curtain and the second curtain.

According to another exemplary embodiment of the present invention, there is provided a double roman shade, including: a first curtain including a first weft and a first warp intersecting the first weft; a second curtain including a second weft and a second warp intersecting the second weft and disposed to face the first curtain; a connection belt formed between the first curtain and the second curtain along a horizontal direction and connecting the first curtain to the second curtain; a cord penetrating through the connection belt to be fixed to lower portions of the first curtain and the second curtain; a rotating bar to which one end of the cord is fixed; a frame having a rotating shaft at both ends of the rotating bar connected to both ends thereof and having the first curtain and the second curtain fixed thereto; and a tow rope adjusting a rotation of the rotating bar.

DESCRIPTION OF THE EXEMPLARY EMBODIMENTS

Hereinafter, a double roman shade curtain and a double roman shade using the same according to exemplary embodiments of the present invention will be described in more detail with reference to the accompanying drawings.

Figure 1:
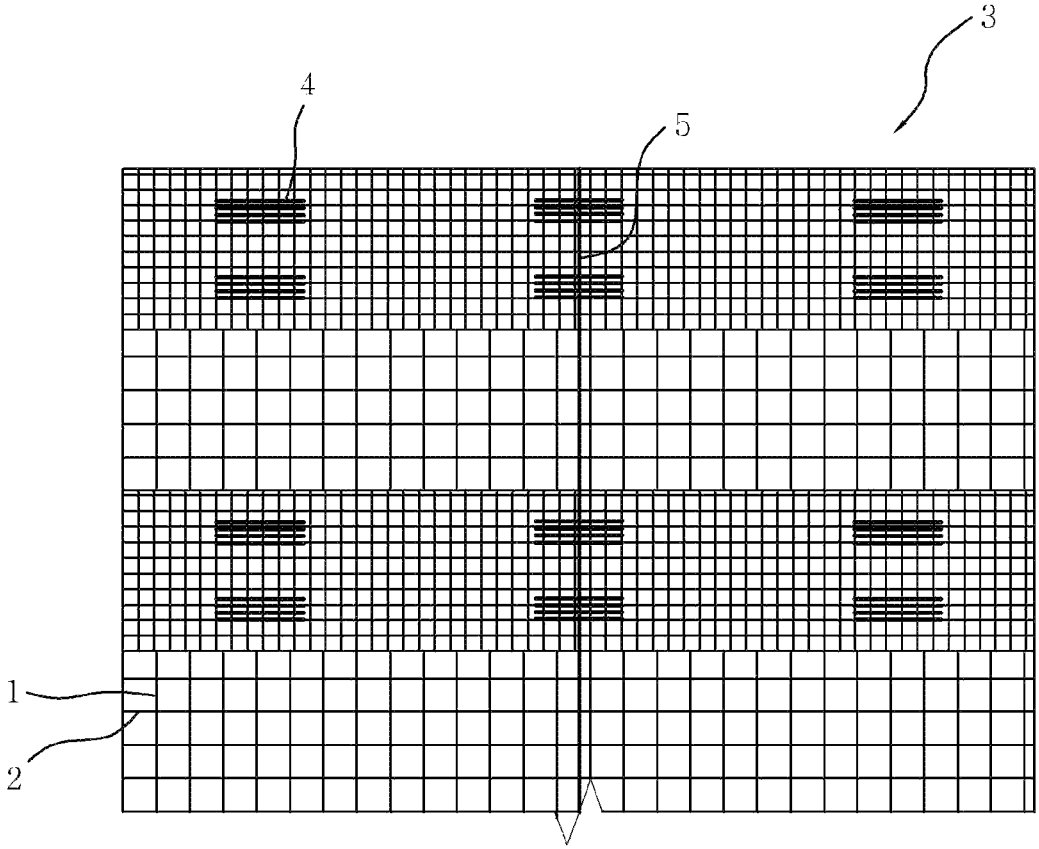
FIG. 1 is a front view illustrating a roman shade type blind according to the related art.
Figure 2:
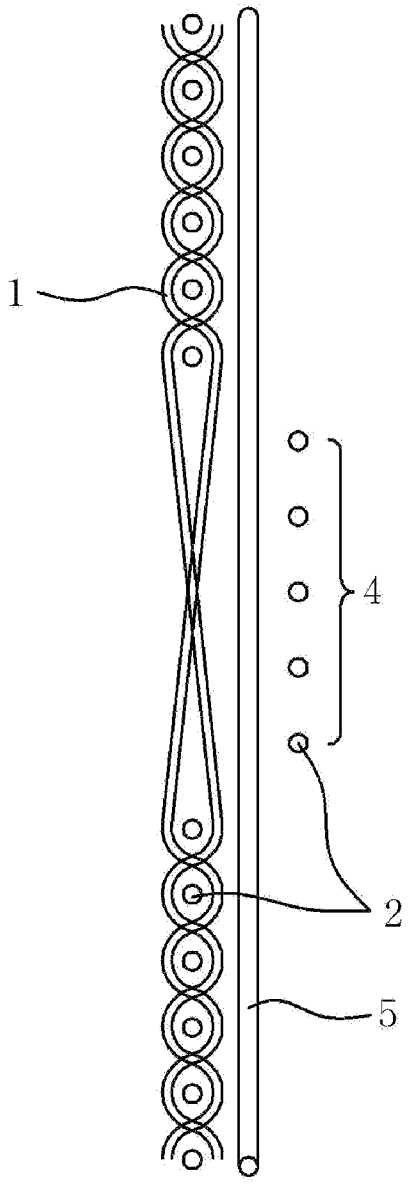
FIG. 2 is a partial side cross-sectional view illustrating the roman shade type blind according to the related art.
Figure 3:
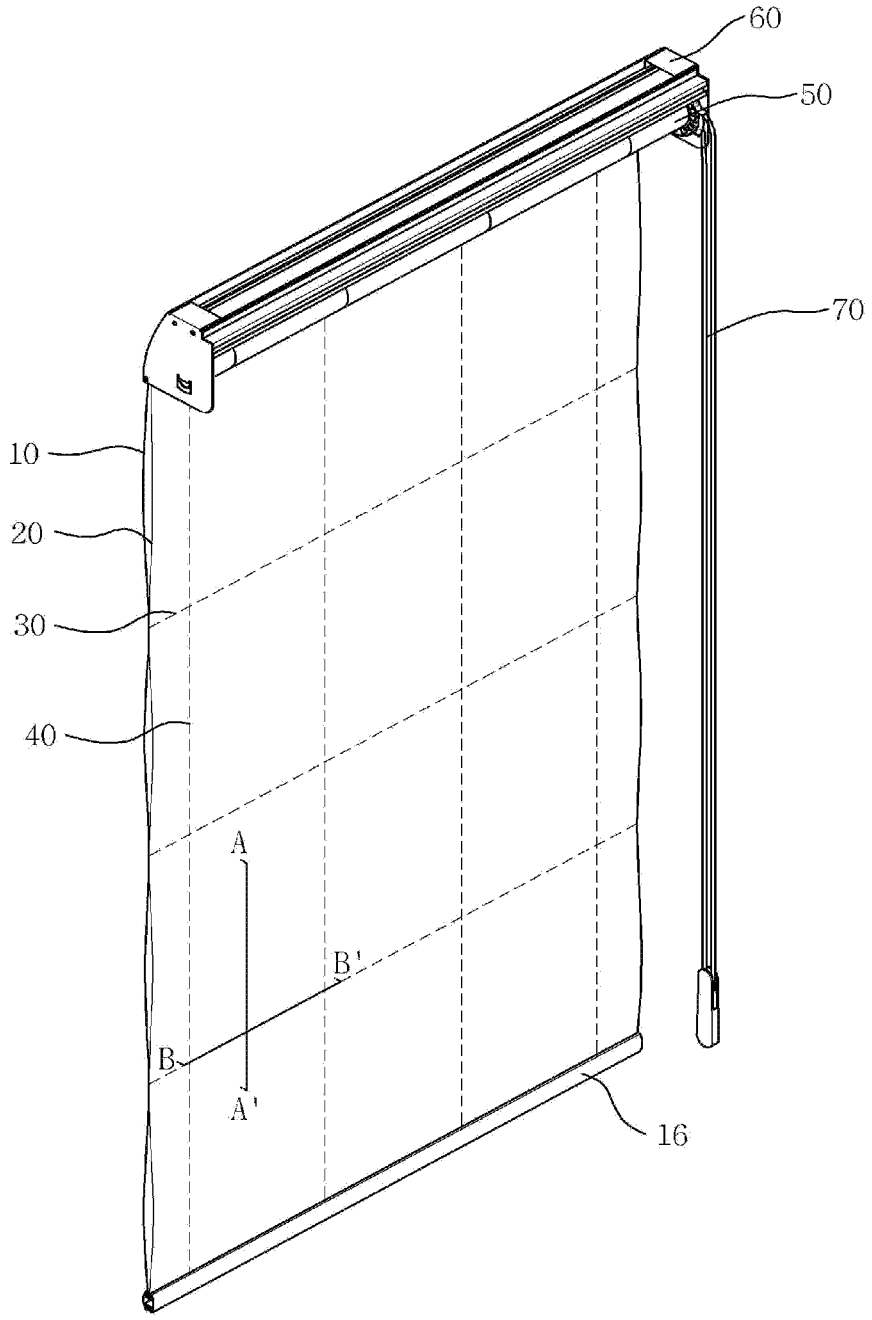
FIG. 3 is a perspective view illustrating a double roman shade according to an exemplary embodiment of the present invention.
Figure 4:
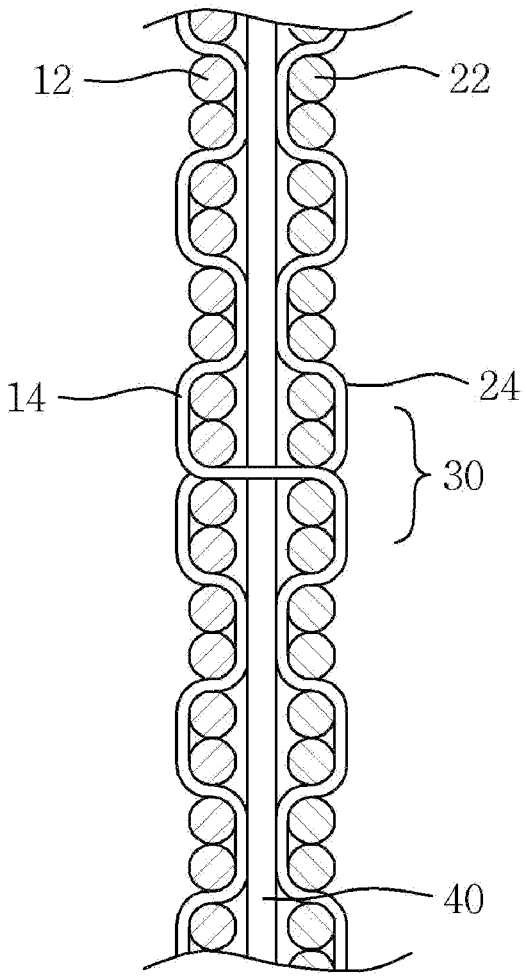
FIG. 4 is a cross-sectional view taken along A-A' of FIG. 3 illustrating first and second curtains according to a first exemplary embodiment of the present invention.
Figure 5:
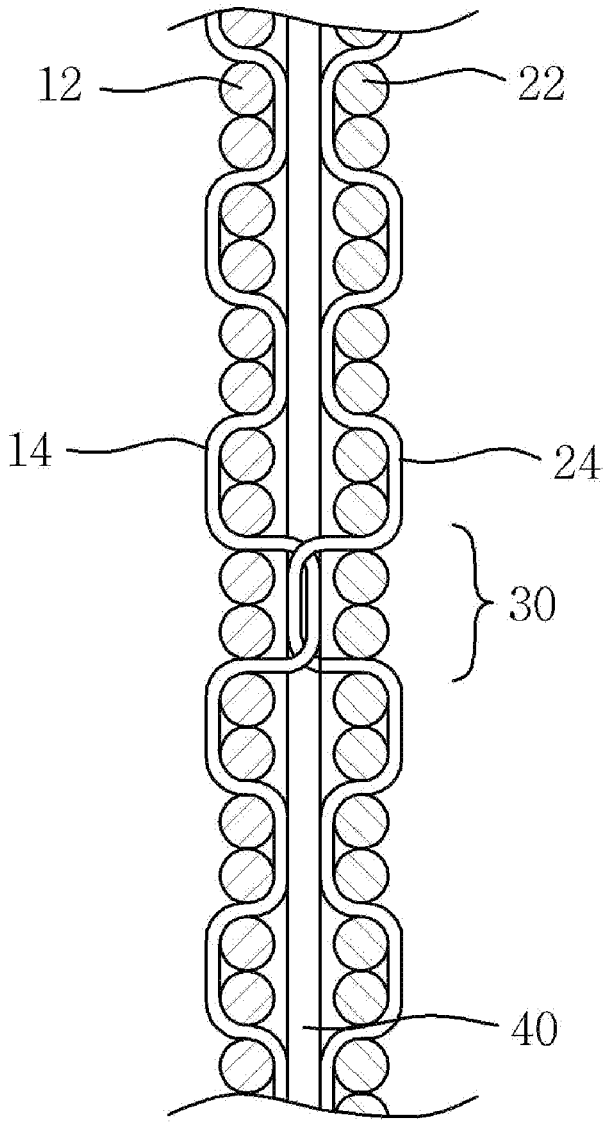
FIG. 5 is a cross-sectional view taken along A-A' of FIG. 3 illustrating first and second curtains according to a second exemplary embodiment of the present invention.
Figure 6:
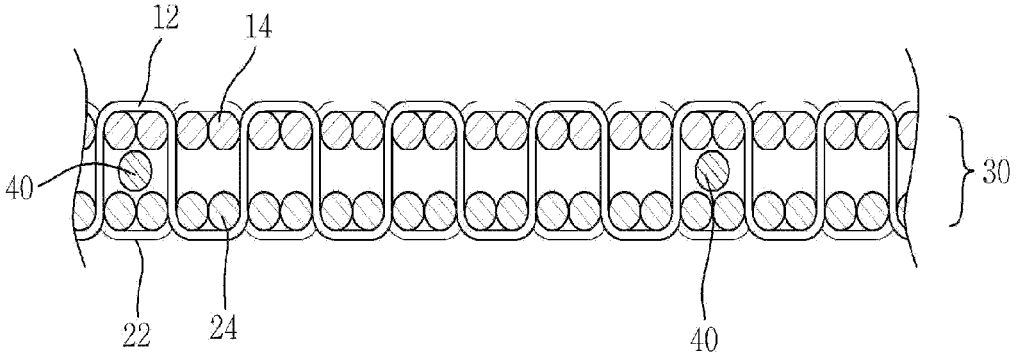
FIG. 6 is a cross-sectional view taken along B-B' of FIG. 3 illustrating first and second curtains according to a third exemplary embodiment of the present invention.

The present invention relates to a double roman shade curtain and a double roman shade using the same. FIG. 3 is a perspective view illustrating a double roman shade according to an exemplary embodiment of the present invention, FIG. 4 is a cross-sectional view taken along A-A' of FIG. 3 illustrating first and second curtains according to a first exemplary embodiment of the present invention, FIG. 5 is a cross-sectional view taken along A-A' of FIG. 3 illustrating first and second curtains according to a second exemplary embodiment of the present invention, and FIG. 6 is a cross-sectional view taken along B-B' of FIG. 3 illustrating first and second curtains according to a third exemplary embodiment of the present invention. The double roman shade curtain according to the exemplary embodiment of the present invention is configured to include a first curtain 10 including a first weft 12 and a first warp 14 intersecting the first weft 12, a second curtain 20 including a second weft 22 and a second warp 24 intersecting the second weft 22 and disposed to face the first curtain 10, a connection belt 30 formed between the first curtain 10 and the second curtain 20 along a horizontal direction and connecting the first curtain 10 to the second curtain 20, and a cord 40 passing through the connection belt 30 to be fixed at lower portions of the first curtain 10 and the second curtain 20.

Further, the double roman shade according to the exemplary embodiment of the present invention is configured to include a first curtain 10 including a first weft 12 and a first warp 14 intersecting the first weft 12, a second curtain including a second weft 22 and a second warp 24 intersecting the second weft 22 and disposed to face the first curtain 10, a connection belt 30 formed between the first curtain 10 and the second curtain 20 along a horizontal direction and connecting the first curtain 10 to the second curtain 20, a cord 40 passing through the connection belt 30 to be fixed at lower portions of the first curtain 10 and the second curtain 20, a rotating bar 50 to which one end of the cord 40 is fixed, a frame 60 having a rotating shaft at both ends of the rotating bar 50 connected to both ends thereof and having the first curtain 10 and the second curtain 20 fixed thereto, and a tow rope 70 adjusting a rotation of the rotating bar 50.

Hereinafter, each component will be described in detail.

The first curtain 10 includes the first weft 12 and the first warp 14 intersecting the first weft 12. Further, the second curtain 20 includes the second weft 22 and the second warp 24 intersecting the second weft 22 and disposed to face the first curtain 10.

As illustrated in FIG. 3, a tension holding bar 16 has a predetermined weight and is disposed at the lower portion of the first curtain 10 and the second curtain 20 to apply gravity to the curtains so as to allow the curtains to less sway from external impact.

The connection belt 30 is formed between the first curtain 10 and the second curtain 20 along a horizontal direction to serve to connect the first curtain 10 to the second curtain 20. Further, the connection belt 30 is not formed by using a separate yarn, but is formed by intersecting the first and second wefts 12 and 22 with the first and second warps 14 and 24 and the cord 40 to be described below passes through the connection belt 40. Therefore, the double roman shade according to the exemplary embodiment of the present invention is integrally woven without forming a separate ring and has a curtain formed in a double type and creases formed in both surfaces, such that it may have a beautiful appearance and may be conveniently installed without dividing a direction at the time of being installed at a window, and the like.

Hereinafter, the first curtain 10 and the second curtain according to the exemplary embodiment of the present invention will be described with reference to FIGS. 4 to 6.

As illustrated in FIG. 4, according to the first exemplary embodiment of the present invention, the first warp descends while intersecting the first weft 12 and then intersects the second weft 22. In the same manner, the second warp 24 descends while intersecting the second weft 22 and then intersects the first weft 12 at a position at which the first warp 14 intersects the second weft 22. Therefore, the first curtain 10 and the second curtain 20 are connected to each other by exchanging the warps and the portion at which the first warp 14 intersects the second warp 24 is the connection belt 30.

In the case of the first exemplary embodiment of the present invention, even though the thicknesses of yarns of the first warp 14 and the second warp 24 or the first weft 12 and the second weft 22 are each used differently, the curtain may be woven without being bent in one direction. That is, when the curtain is woven by each yarn in the state in which the thickness of a yarn used for the first curtain 10 and the thickness of a yarn used for the second curtain 20 are different, the sizes of the first curtain 10 and the second curtain 20 are different from each other, and therefore the first exemplary embodiment of the present invention may solve the above-mentioned problem by intersecting the yarn during the operation.

As illustrated in FIG. 5, according to the second exemplary embodiment of the present invention, after the first warp 14 descends while intersecting the first weft 12 and the second warp 24 descends while intersecting the second weft 22, the first warp 14 and the second warp 24 are twisted at a predetermined position. Then, the first warp 14 intersects the first weft 12 again and the second warp 24 intersects the second weft 22. Therefore, the first curtain 10 and the second curtain 20 are connected to each other by twisting the warps and the portion at which the first warp 14 and the second warp 24 are twisted is the connection belt 30.

As illustrated in FIG. 6, according to the third exemplary embodiment of the present invention, the first weft 12 intersects the first and second warps 14 and 24 and the second weft 22 intersects the first and second warps 14 and 24. That is, the first and second warps 14 and 24 intersect each other like the form in which the first weft 12 and the second weft 22 intersect each other and a portion at which the first weft 12 and the second weft 22 intersect each other is a connection belt 30. Unlike the first and second exemplary embodiments, according to the third exemplary embodiment, since the connection belt 30 is formed by intersecting the wefts, the thickness of the connection belt 30 may be adjusted by increasing the number of intersecting wefts. Therefore, the first curtain 10 may be further firmly connected to the second curtain 20 and the crease form of the double roman shade according to the exemplary embodiment of the present invention may be variously adjusted.

As described above, the connection belt 30 may be formed by various methods and if necessary, a plurality of connection belts 30 may be formed along the vertical direction to increase the number of creases of the double roman shade according to the exemplary embodiment of the present invention.

One end of the cord 40 is fixed to the rotating bar 50 to be described below and the other end thereof passes through the connection belt 30 and then fixed to the lower portions of the first curtain 10 and the second curtain 20, such that the cord 40 may be wound or released by the rotation of the rotating bar 50 to fold or unfold the first curtain 10 and the second curtain 20.

Meanwhile, since the cord 40 is disposed between the first curtain 10 and the second curtain 20 so as not to be exposed to the outside, the accidents that the cord is wound around a child's body during playing or the operation of the roman shade, and the like, may be prevented. In particular, since the double roman shade according to the related art has a structure in which the cord 40 is exposed to the outside, the cord 40 is made of a transparent, thin, and hard material so as not to reveal the cord 40 in appearance. Therefore, the adult let alone the child may not easily recognize the exposed cord 40, such that the accidents may often occur. Since the double roman shade according to the exemplary embodiment of the present invention has a structure in which the cord is not exposed to the outside, the cord 40 is made of an opaque material, such that the cord 40 exposed to the outside may be easily recognized.

Further, the plurality of cords 40 are disposed in plural along the horizontal direction, such that the double roman shade according to the exemplary embodiment of the present invention may be stably operated.

The first curtain 10, the second curtain 20, and the cord 40 are integrally woven and if necessary, the first curtain 10 and the second curtain 20 are first woven, and then the cord 40 may be separately inserted between the first curtain 10 and the second curtain 20.

The rotating bar 50 is a rotating element to operate the double roman shade according to the exemplary embodiment of the present invention and is connected to the frame 60 to be described below. Further, the rotating bar 50 is connected to one end of the cord 40, and thus the cord 40 is wound or released by the rotation of the rotating bar 50.

As illustrated in FIG. 3, both ends in the frame 60 are connected to the rotating shaft at both ends of the rotating bar 50, and thus the rotating bar 50 may rotate to the frame 60. The frame 60 is attached at a position at which the double roman shade according to the exemplary embodiment of the present invention is installed.

The tow rope 70 is wound around one end of the rotating bar 50 to serve to control the rotation of the rotating bar 50.

Figure 7:
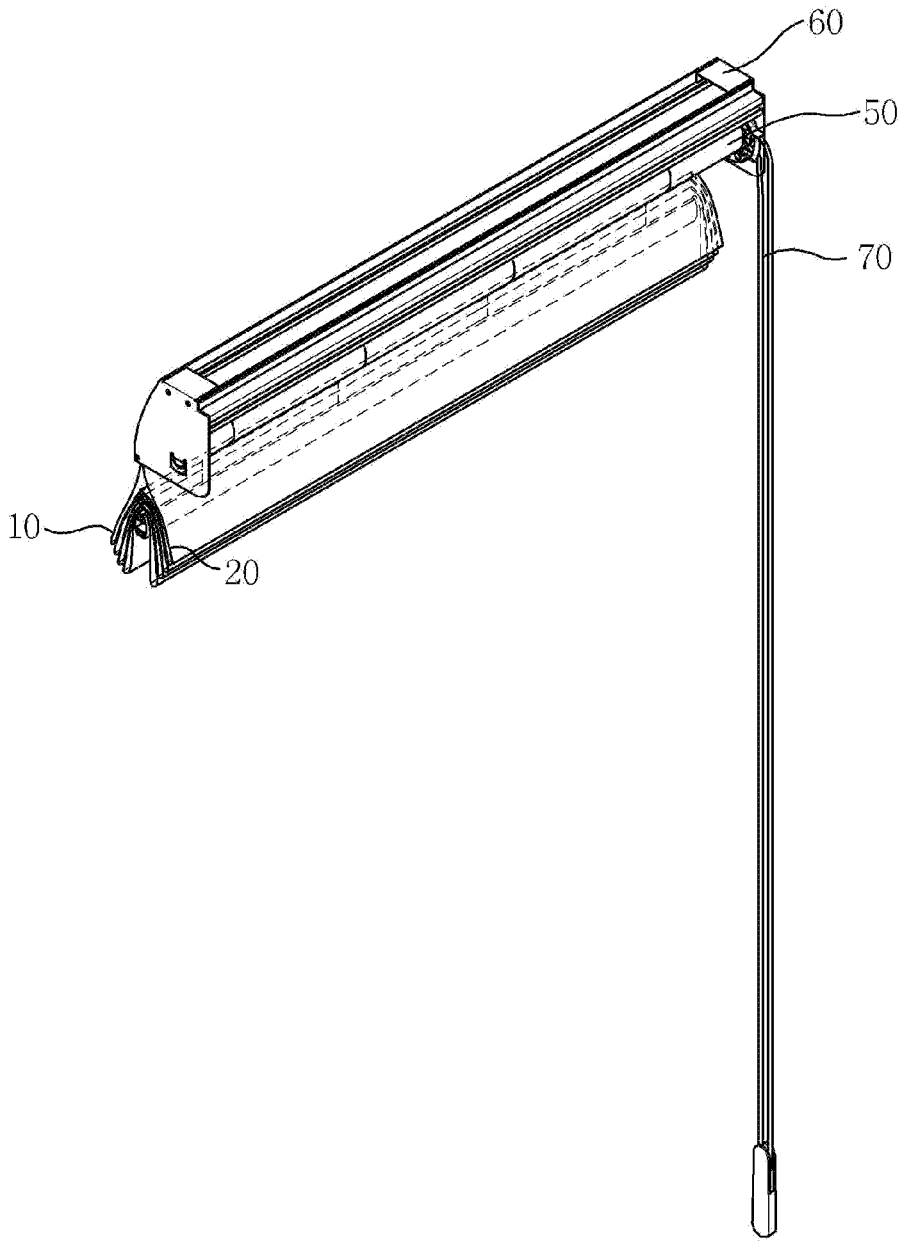
FIG. 7 is a perspective view illustrating an operational state of the double roman shade according to the exemplary embodiment of the present invention.

Hereinafter, an operational state of the double roman shade according to the exemplary embodiment of the present invention will be described with reference to the accompanying drawings. FIG. 7 is a perspective view illustrating an operational state of the double roman shade according to the exemplary embodiment of the present invention.

When the rotating bar 50 rotates through the tow rope 70, the first curtain 10 and the second curtain 20 start to ascend from below while the cord 40 is wound around the rotating bar 50. In this case, when the lower portions of the first curtain 10 and the second curtain 20 are folded with the connection belt 30, the first curtain 10 and the second curtain 20 are formed with a crease and when the cord 40 is completely wound around the rotating bar 50, the creases are formed as many as the number of connection belts 30 as illustrated in FIG. 7.

Figure 8A:
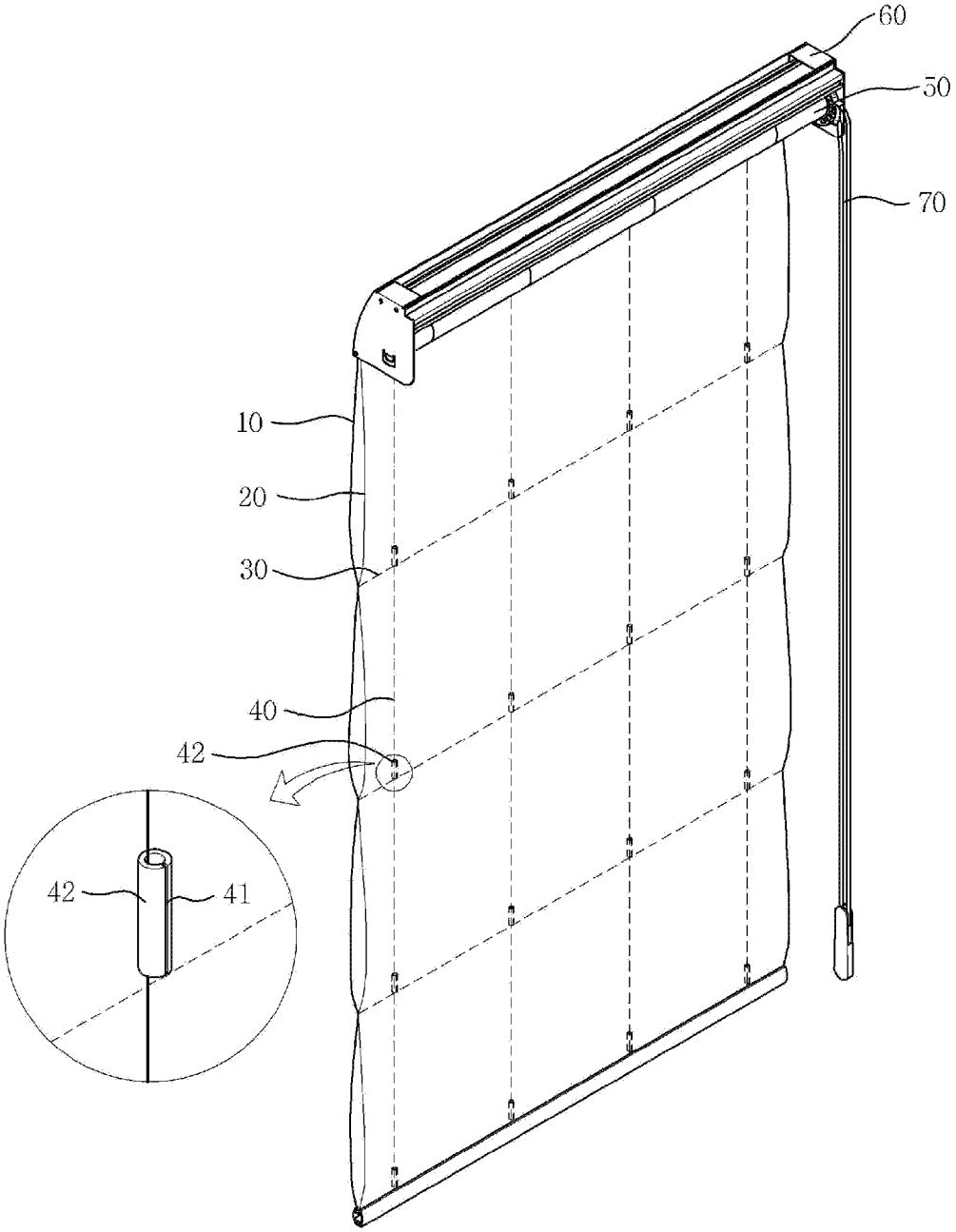
FIG. 8A is a perspective view illustrating an interval holding member when the double roman shade is unfolded according to an exemplary embodiment of the present invention.
Figure 8B:
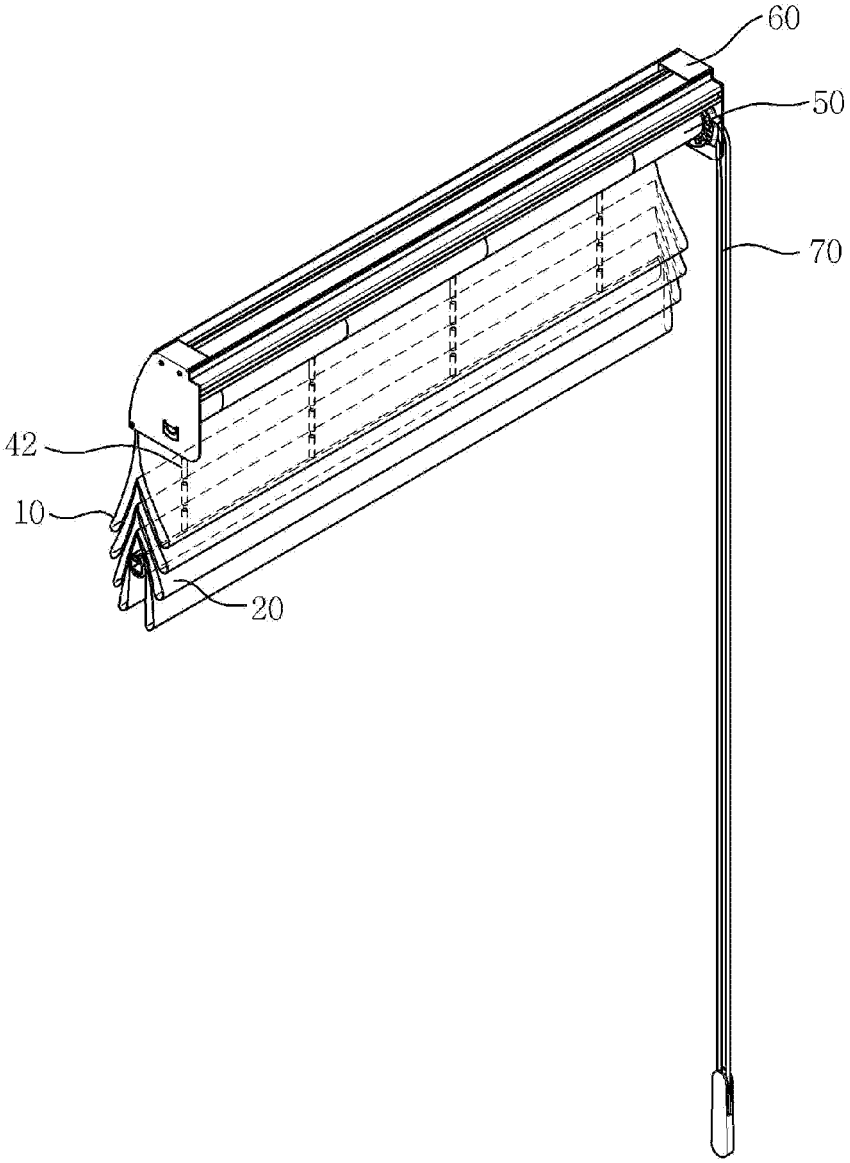
FIG. 8B is a perspective view illustrating an interval holding member when the double roman shade is folded according to an exemplary embodiment of the present invention.
Figure 9:
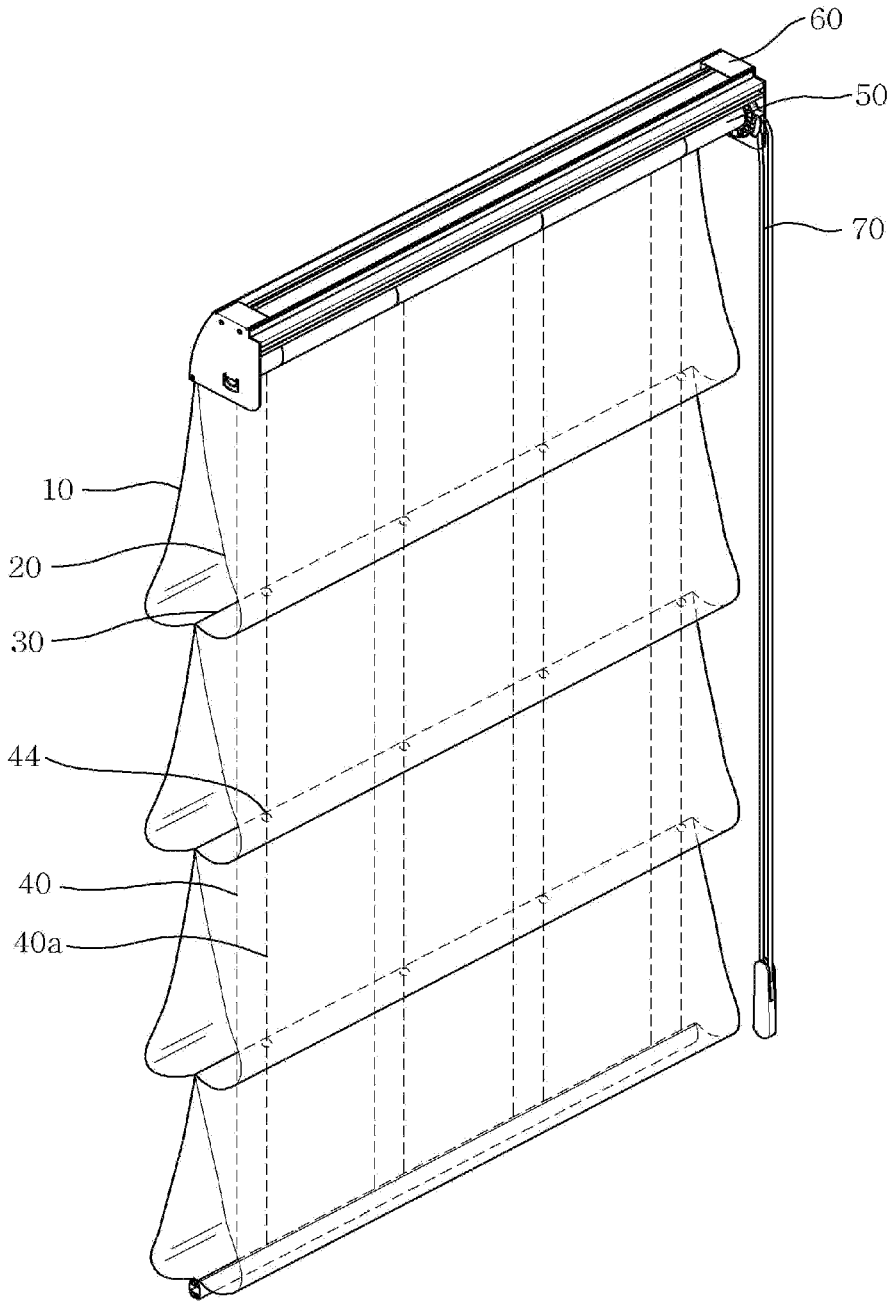
FIG. 9 is a perspective view illustrating a fixed bead according to an exemplary embodiment of the present invention.

FIG. 8A is a perspective view illustrating an interval holding member when the double roman shade is unfolded according to the exemplary embodiment of the present invention, FIG. 8B is a perspective view illustrating an interval holding member when the double roman shade is folded according to the exemplary embodiment of the present invention and FIG. 9 is a perspective view illustrating a fixed bead according to the exemplary embodiment of the present invention.

The interval holding member 42 has a pillar or pipe shape as illustrated in FIG. 8A and is installed on the cord 50 and if necessary, a side thereof is provided with a slit 41 to be easily installed. When creases are formed, the interval holding member 42 is disposed between the connection belts 30 to make the interval between the connection belts 30 constant and as illustrated in FIG. 8B, when the first curtain 10 and the second curtain 20 are folded, creases are formed at a predetermined interval.

The fixed bead 44 is a bead formed with a through hole and as illustrated in FIG. 9, is fixed on auxiliary cords 40*a* fixed to the lower and upper portions of the first curtain 10 and the second curtain 20, such that when the curtains are unfolded, the fixed bead 44 is hung on the connection belt 30, the curtains are no more unfolded, and the creases are formed.

Meanwhile, the double roman shade according to the exemplary embodiment of the present invention formed with the fixed bead 44 may be further provided with the interval holding member 42. When the curtain is unfolded, the curtain is not completely unfolded by the fixed bead 44 and to the contrary, when the curtain is folded, a layer is formed on the curtain at a predetermined interval by the interval holding member 42.

According to the exemplary embodiment of the present invention, the double roman shade curtain and the double roman shade using the same can be integrally woven without separately forming the ring and prevent accidents that children are wound with the cord.

Further, the roman shade can be formed in both surfaces, thereby having a beautiful appearance, being installed without dividing the front and back faces, and having the excellent durability.

What is claimed is:

1. A double roman shade curtain, comprising:

a first curtain having an upper part and a lower part, the upper part of the first curtain including a first weft woven with a first warp, the lower part of the first curtain including the first weft woven with a second warp;

a second curtain having an upper part and a lower part, the upper part of the second curtain including a second weft woven with a second warp, the lower part of the second curtain including the second weft woven with the first warp; and a cord passing through a connection belt and fixed to lower portions of the first curtain and the second curtain, wherein the first warp passes from the upper part of the first curtain to the lower part of the second curtain, and the second warp passes from the upper part of the second curtain to the lower part of the first curtain at the connection belt between the first and second curtains.

2. The double roman shade curtain of claim 1, further comprising a second connection belt.

3. The double roman shade curtain of claim 1, further comprising a second cord.

4. A double roman shade, comprising:

a first curtain having an upper part and a lower part, the first curtain including a first weft woven with a first warp;

a second curtain having an upper part and a lower part, the second curtain including a second weft woven with a second warp;

a cord passing through a connection belt and fixed to lower portions of the first curtain and the second curtain, wherein the first warp passes from the upper part of the first curtain to the lower part of the first curtain at the connection belt, and the second warp passes from the upper part of the second curtain to the lower part of the second curtain at the connection belt, and wherein the first warp twists around the second warp at the connection belt.

5. The double roman shade of claim 4, further comprising a second connection belt.

6. The double roman shade of claim 4, further comprising a second cord.

7. The double roman shade of claim 4, wherein the cord is further provided with an interval holding member.

8. The double roman shade of claim 4, further comprising:

an auxiliary cord having one end fixed to upper portions of the first curtain and the second curtain and the other end passing through the connection belt to be fixed to the lower portions of the first curtain and the second curtain, wherein the auxiliary cord is further provided with a fixed bead.

9. The double roman shade of claim 1, wherein the cord is further provided with an interval holding member.

10. The double roman shade of claim 1, further comprising:

an auxiliary cord having one end fixed to upper portions of the first curtain and the second curtain and the other end passing through the connection belt to be fixed to the lower portions of the first curtain and the second curtain, wherein the auxiliary cord is further provided with a fixed bead.

11. A double roman shade, comprising:

a first curtain including a first weft woven with a first warp;

a second curtain including a second weft woven with a second warp; and a cord passing through a connection belt and fixed to lower portions of the first curtain and the second curtain, wherein the first weft passes from the first curtain and is woven with the second warp in the second curtain, and the second weft passes from the second curtain and is woven with the first warp in the first curtain.

12. The double roman shade of claim 11, wherein the cord is further provided with an interval holding member.

13. The double roman shade of claim 11, further comprising:

an auxiliary cord having one end fixed to upper portions of the first curtain and the second curtain and the other end passing through the connection belt to be fixed to the lower portions of the first curtain and the second curtain, wherein the auxiliary cord is further provided with a fixed bead.

* * * * *